US007604123B2

(12) United States Patent
Seals

(10) Patent No.: US 7,604,123 B2
(45) Date of Patent: Oct. 20, 2009

(54) INFLATABLE FREIGHT PROTECTION DEVICE WITH CINCHING CORD

(76) Inventor: Elizabeth Rutledge Seals, 1008 Thomcrest Dr., Fletcher, NC (US) 28732

( * ) Notice: Subject to any disclaimer, the term of this patent is extended or adjusted under 35 U.S.C. 154(b) by 0 days.

(21) Appl. No.: 11/760,033

(22) Filed: Jun. 8, 2007

(65) Prior Publication Data

US 2008/0011623 A1 Jan. 17, 2008

Related U.S. Application Data

(60) Provisional application No. 60/804,356, filed on Jun. 9, 2006.

(51) Int. Cl.
*B65D 81/03* (2006.01)
*B65D 30/10* (2006.01)

(52) U.S. Cl. ..... 206/522; 383/3

(58) Field of Classification Search ..... 206/522; 383/3, 71–77

See application file for complete search history.

(56) References Cited

U.S. PATENT DOCUMENTS 1,457,496 A * 6/1923 Butler ..... 206/522
2,462,215 A * 2/1949 Norman et al. ..... 383/3
4,489,833 A * 12/1984 Bauer ..... 206/522
4,573,202 A * 2/1986 Lee ..... 383/3
5,180,060 A * 1/1993 Forti et al. ..... 206/522
5,564,570 A * 10/1996 Jaszai ..... 206/522
5,624,035 A * 4/1997 Kim ..... 206/522
5,895,118 A * 4/1999 Hensley ..... 383/3
6,375,009 B1 * 4/2002 Lee ..... 206/522
6,379,777 B1 * 4/2002 Ota et al. ..... 206/522
2003/0024846 A1 * 2/2003 Nadler ..... 206/522

* cited by examiner

*Primary Examiner*—Bryon P Gehman
(74) *Attorney, Agent, or Firm*—Trego, Hines & Ladenheim, PLLC

(57) ABSTRACT

A freight protection device for surrounding an article being transported to a destination by a shipping company and protect the article from being damaged. The freight protection device includes an outer cover, a bladder positioned within the outer cover, and an inflation device operably connected to the bladder to inflate the bladder around an article positioned therein. The protection device may also include a layer of padding for protecting the article.

5 Claims, 6 Drawing Sheets

INFLATABLE FREIGHT PROTECTION DEVICE WITH CINCHING CORD

CROSS-REFERENCE TO RELATED APPLICATIONS

This application claims the benefit of Provisional Application No. 60/804,356 filed on Jun. 9, 2006.

TECHNICAL FIELD AND BACKGROUND OF THE INVENTION

The present invention relates to the field of freight protection, particularly, the invention relates to freight protection devices that surround a package or other item to protect it and prevent it from being damaged.

Individuals and companies alike ship packages using a variety of shipping companies. One common problem in the shipping industry is the protection of the packages or items being shipped. As packages are being loaded/unloaded into or out of air-, land-, or water-based vehicles, they can be damaged by machinery or by dropping the packages. Additionally, the packages can be damaged during shipment due to shifting of the packages or by the weight of packages stacked on top of each other. Packages may also be damaged by conveyor systems that transport the packages within a facility. As a result, packages may arrive at their destination damaged.

SUMMARY OF THE INVENTION

Therefore it is an object of the invention to provide a freight protection device that can protect a package or other item during the delivery process.

It is an object of he invention to provide a freight protection device that surrounds a package or other item.

It is another object of the invention to provide a freight protection device that can be reused.

It is another object of the invention to provide a freight protection device that is lightweight.

It is another object of the invention to provide a freight protection device that is inflatable.

It is another object of the invention to provide a freight protection device that is environmentally friendly.

These and other objects of the present invention are achieved in the preferred embodiments disclosed below by providing a freight protection device having an outer cover, a bladder positioned within the outer cover, and an inflation device operably connected to the bladder to inflate the bladder around an article positioned therein.

According to another preferred embodiment of the invention, a freight protection device includes a pouch and an inflation device operably connected to the pouch. The pouch includes an outer cover and a bladder positioned in the cover. The inflation device inflates the bladder.

According to another preferred embodiment of the invention, a freight protection device includes a protective outer cover and an air valve. The protective outer cover includes an inflatable bladder and an elastic cord for cinching the bladder around an article. The air valve is operably connected to the bladder for inflating the bladder around the article. The cover is positioned around the article such that the elastic cord secures the cover to the article and the bladder is inflated to provide a cushion.

BRIEF DESCRIPTION OF THE DRAWINGS

The invention may be best understood by reference to the following description in conjunction with the accompanying drawing figures in which.

DESCRIPTION OF THE PREFERRED EMBODIMENT AND BEST MODE

Figure 1:
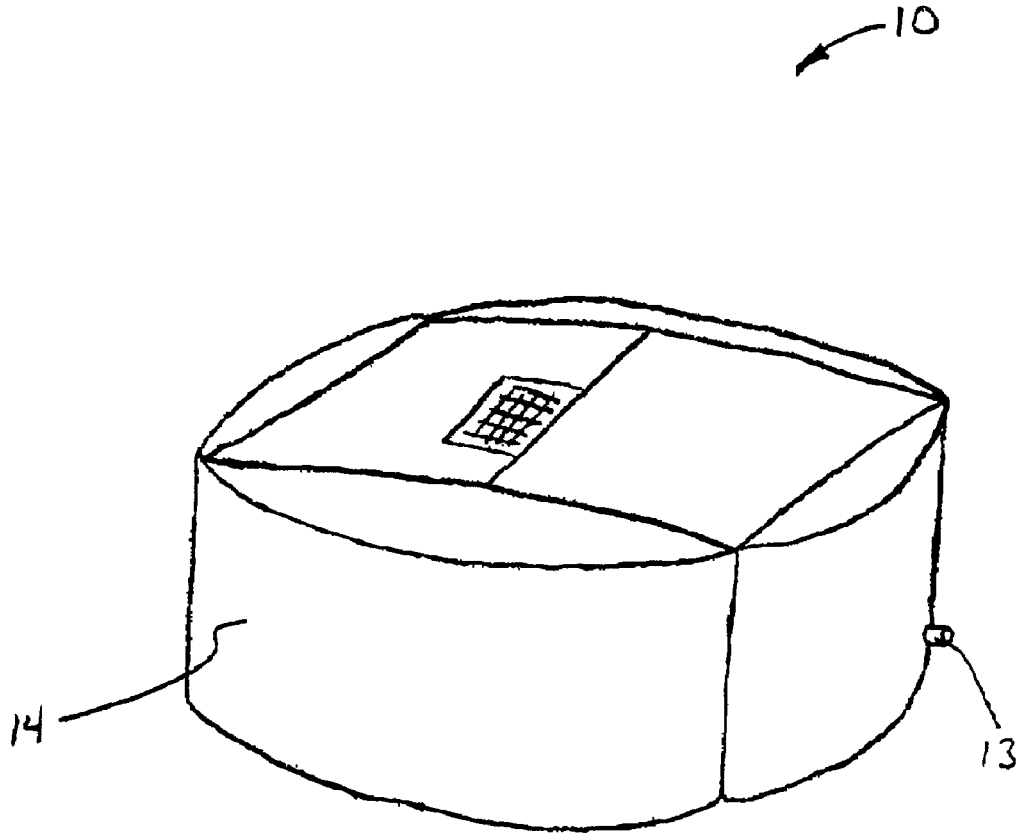
FIG. 1 shows a freight protection device according to an embodiment of the invention.
Figure 2:
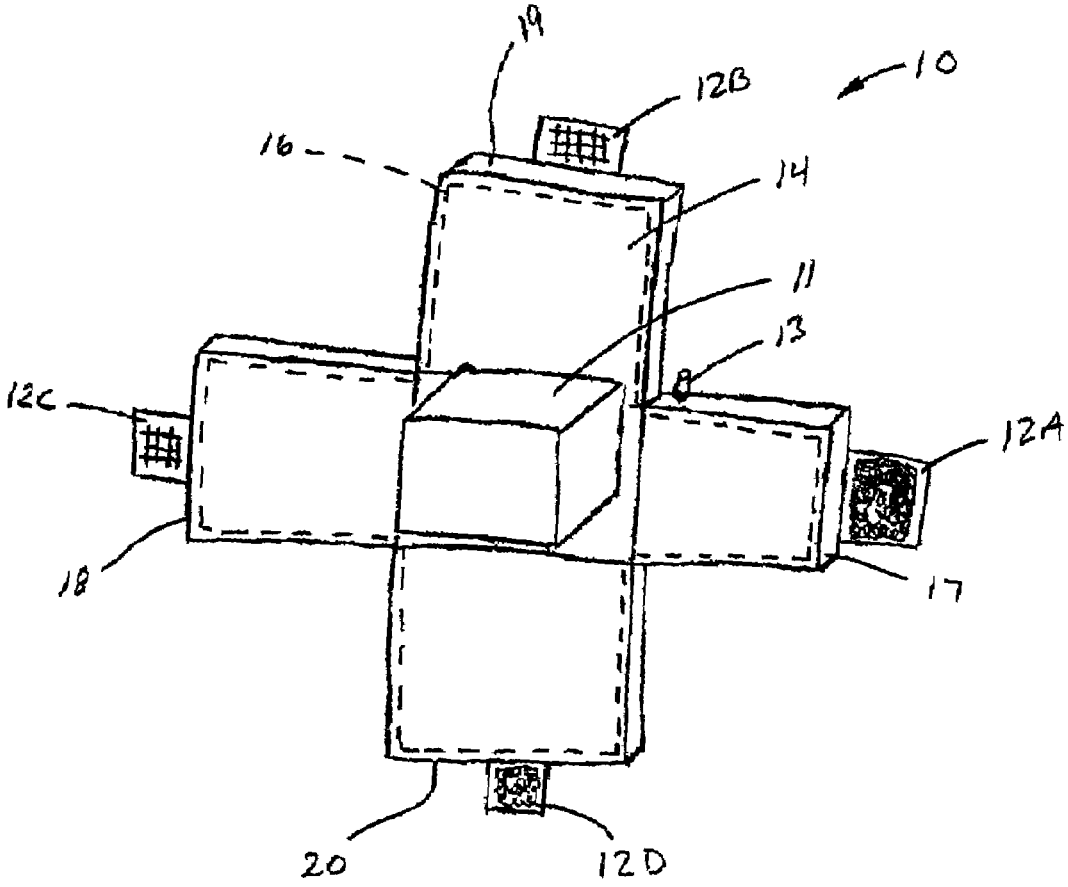
FIG. 2 shows the freight protection device of FIG. 1 in its open condition.

Referring now specifically to the drawings, a freight protection device according to an embodiment of the invention is illustrated in FIGS. 1 and 2 and shown generally at reference numeral 10. The freight protection device 10 is designed to completely surround a package 11. While the present invention is described and illustrated in an example using a standard package comprising an item enclosed in a box, carton, or the like, it is noted that the device 10 it is equally useful for the protection of unwrapped or unpackaged articles or items. For example, it may be used to protect and ship machine parts or other large, odd-shaped, or bulky items without the need for a box or crate, and the term "package" is intended to encompass such articles or items.

As shown in FIG. 2, the freight protection device 10 is cross-shaped and includes mating fasteners 12A-12D to secure the freight protection device 10 around the package 11. The fasteners 12A-12D may be hook and loop fasteners, snaps, buttons, D-ring and strap, or any other suitable fastener that allows the freight protection device 10 to be easily secured around and easily removed from the package 11. The freight protection device 10 includes an outer cover 14 that may be made of a fabric, canvas, nylon, vinyl, leather, UV resistant material, heat resistant material, or any other suitable material, and can be sized to fit a variety of package sizes.

The freight protection device 10 includes a bladder 16 that may be formed as a part of or positioned within the outer cover 14. The outer cover 14 provides protection to the bladder 16 and the contents therein. An air valve 13 is operably connected to the bladder 16 for inflating the freight protection device 10 around the package 11, as shown in FIG. 1. Padding or a padding layer (not shown) may also be formed as a part of or positioned within the outer cover 14 to provide a cushioned protection barrier without inflating the bladder 16 or to provide additional protection in combination with the bladder 16.

In use, the package 11 is placed in the center of the freight protection device 10. The freight protection device 10 is then secured around the package 11 by wrapping two opposing ends 17 and 18 around the package 11 and securing the opposing ends 17 and 18 together using the fasteners 12A and 12C. Opposing ends 19 and 20 are then wrapped around the package 11 and secured to each other using the fasteners 12B and 12D. It should be appreciated that the sequence of wrapping the package is for illustration purposes, ends 19 and 20 could be wrapped around the package before ends 17 and 18. The freight protection device is then inflated using the air valve 13 to provide a cushioned protection barrier around the package 11, as shown in FIG. 1. When the package 11 has reached its destination, the package 11 is removed from the freight protection device 10. The freight protection device 10 may then be reused to protect another package.

Figure 3:
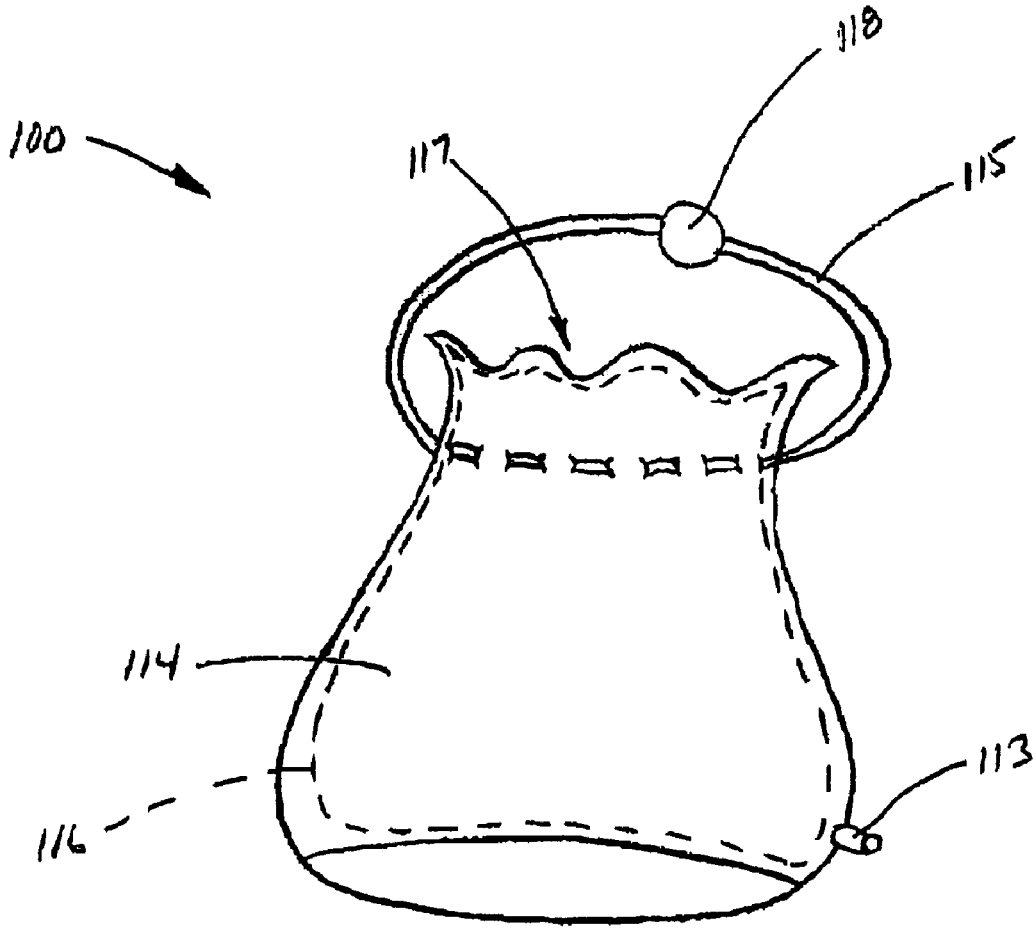
FIG. 3 shows a freight protection device according to an alternate embodiment of the invention.
Figure 4:
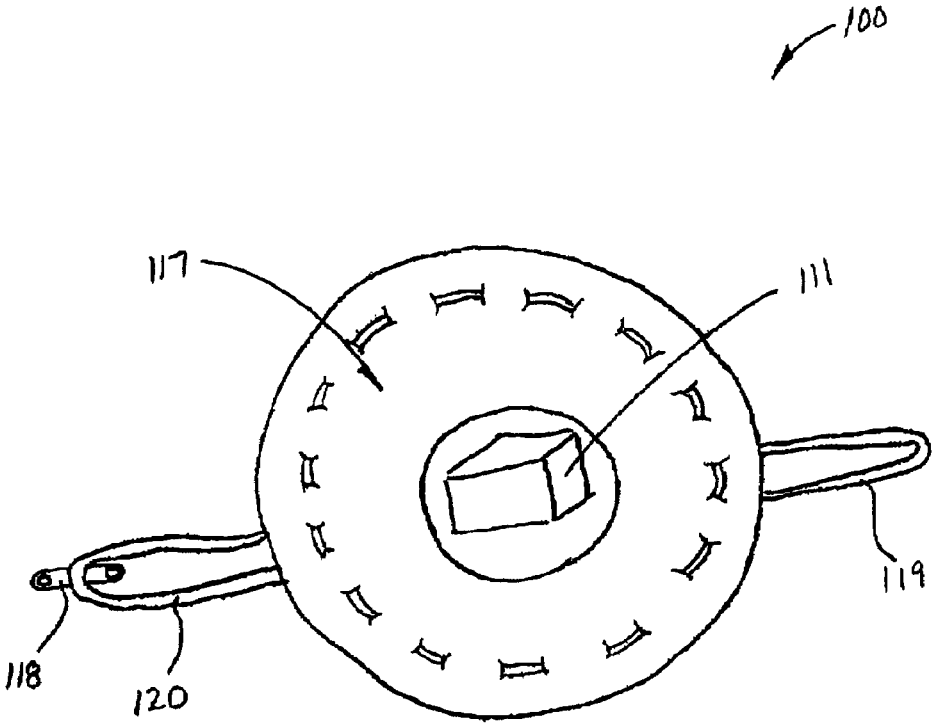
FIG. 4 shows the freight protection device of FIG. 3 in its open condition.

Referring to FIGS. 3 and 4, a freight protection device according to an embodiment of the invention is shown generally at reference numeral 100. The freight protection device 100 is in the form of a pouch or bag and includes an outer cover 114 that may be made of fabric, canvas, nylon, vinyl, leather, UV resistant material, heat resistant material, or any other suitable material, and can be sized to fit a variety of package sizes. A bladder 116 is formed as a part of or positioned within the outer cover 114. Padding or a padding layer (not shown) may also be formed as a part of or positioned within the outer cover 114. The freight protection device 100 also includes an air valve 113 operably connected to the bladder 116, and a handle/drawstring 115 formed by end loops 119 and 120 for cinching or closing an opening 117, as well as providing a means for carrying the freight protection device 100. The handle/drawstring 115 may be made of rope, leather, vinyl, or any other suitable material. A clasp 118 secures the end loops 119 and 120 together to form the handle/drawstring 115.

As shown in FIG. 4, in its open condition, the freight protection device 100 allows a package 111 to be placed through the opening 117 and into its interior. In this condition, the end loops 119 and 120 are relaxed to allow the opening 117 to be opened fully. Once the package 111 has been positioned within the freight protection device 100, the end loops 119 and 120 are used to close the opening 117. The end loops 119 and 120 are secured together by the clasp 118 to form the handle/drawstring 115, shown in FIG. 3. The air valve 113 is then used to inflate the bladder 116, thereby providing a cushioned protection barrier around the package 111.

Figure 5:
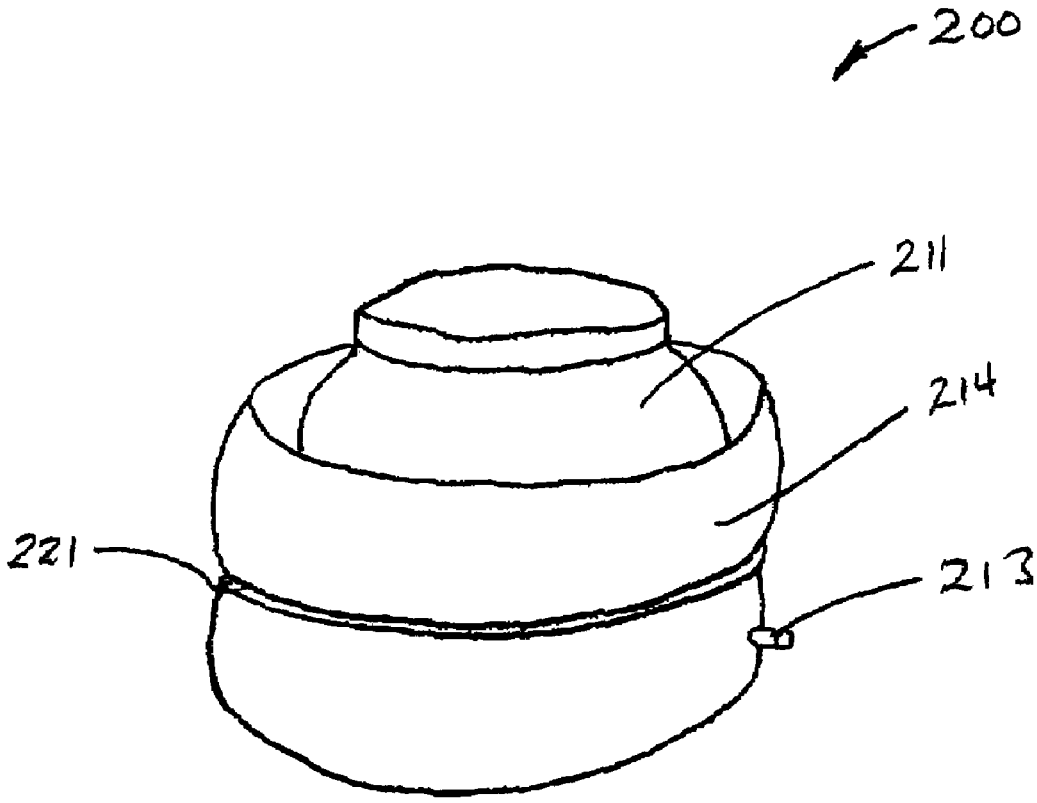
FIG. 5 shows a freight protection device according to another embodiment of the invention.
Figure 6:
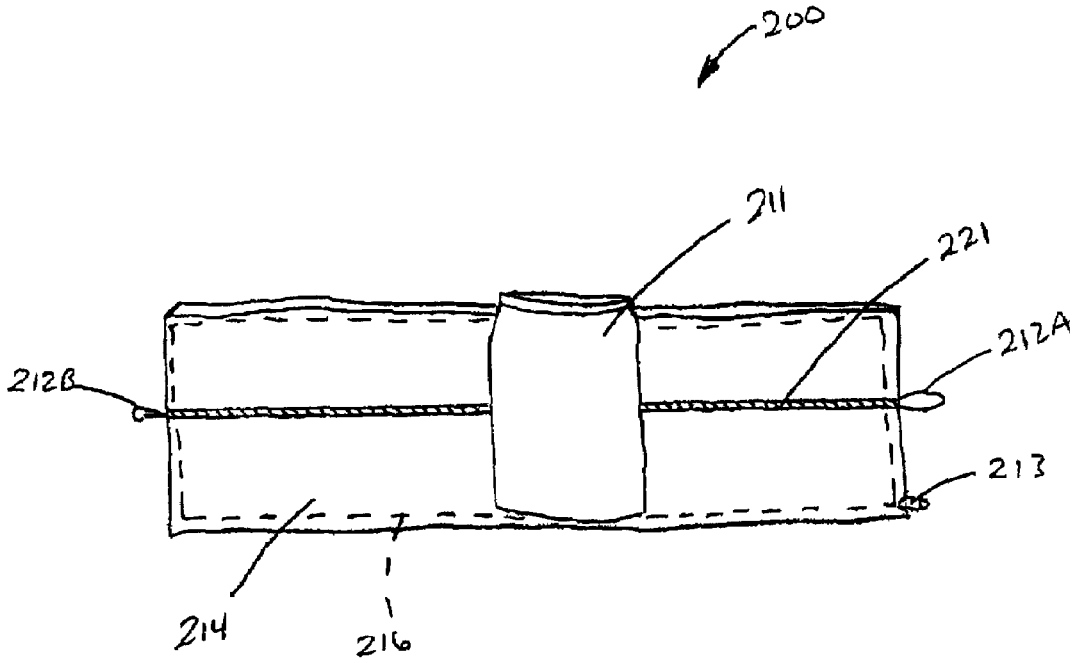
FIG. 6 shows the freight protection device of FIG. 5 in its open condition.

Referring to FIGS. 5 and 6, a freight protection device according to another embodiment of the invention is shown generally at reference numeral 200. The freight protection device 200 is in the form of an elongate sheet that is designed to be wrapped around a package 211. Mating fasteners 212A and 212B are positioned on opposing ends of the freight protection device 200 to secure it around the package 211. Additionally, the fasteners 212A and 212B can be used to attach the freight protection device 200 to additional freight protection devices in an end-to-end relationship to wrap around larger packages.

The fasteners 212A and 212B are connected to an elastic cord 221 that runs substantially through a center of the freight protection device 200. As shown in FIG. 5, the elastic cord 221 pulls the center of the freight protection device 200 inwardly towards the package 211 to hold the freight protection device 200 snugly against the package 211.

The freight protection device 200 includes an outer cover 214 that may be made of fabric, canvas, nylon, vinyl, leather, UV resistant material, heat resistant material, or any other suitable material, and can be sized to fit a variety of package sizes. A bladder 216 is formed as a part of or positioned within the outer cover 214. An air valve 213 is operably connected to the bladder 216. Padding or a padding layer (not shown) may also be formed as part of or positioned within the outer cover 214.

A freight protection device is described above. Various details of the invention may be changed without departing from its scope. Furthermore, the foregoing description of the preferred embodiments of the invention and best mode for practicing the invention are provided for the purpose of illustration only and not for the purpose of limitation.

I claim:

1. A freight protection device, comprising:

(a) an inflatable bladder protected by an outer cover;

(b) an elastic cord positioned substantially along a center of the bladder such that when the device is wrapped around an article, the elastic cord nulls a center of the device inwardly towards the article, thereby cinching and securing the device around the article; and (c) an air valve operably connected to the bladder for inflating the bladder around the article to provide protection to the article.

2. The freight protection device according to claim 1, wherein the device is an elongate sheet.

3. The freight protection device according to claim 2, wherein opposing ends of the elongate sheet each include a mating fastener for securing the opposing ends together when the device is positioned around the article.

4. The freight protection device according to claim 1, wherein the device is wrapped around the article.

5. The freight protection device according to claim 1, further including a layer of padding carried by the bladder or the cover for cushioning the article.

* * * * *